United States Patent [19]

Prochnow

[11] Patent Number: 4,817,508

[45] Date of Patent: Apr. 4, 1989

[54] OPPOSED BLADE BALANCED DAMPER

[75] Inventor: Kenneth Prochnow, Madison, Wis.

[73] Assignee: Carnes Company, Inc., Verona, Wis.

[21] Appl. No.: 117,486

[22] Filed: Nov. 5, 1987

[51] Int. Cl.[4] ..... F24F 13/10

[52] U.S. Cl. ..... 98/41.1; 98/116; 251/212; 251/279

[58] Field of Search ..... 98/41.1, 116; 251/212, 251/228, 279, 284, 297

[56] References Cited

U.S. PATENT DOCUMENTS

| | | | |
|---|---|---|---|
| 2,400,044 | 5/1946 | Hermanson | 98/41.1 |
| 2,783,702 | 3/1957 | O'Day | 98/41.1 |
| 3,072,041 | 1/1963 | Downing | 98/116 |
| 3,095,178 | 6/1963 | Veber | 98/41.1 X |
| 4,067,540 | 1/1978 | Slade | 251/212 X |
| 4,628,954 | 12/1986 | Dayus | 251/212 X |

OTHER PUBLICATIONS

Nailor-Hart Industries, Inc. Drawing 4200-6 titled "Radial Opposed Blade Damper Model 4276 Integral Mounting".

Nailor-Hart Industries Inc. Drawing 4200-7, titled "Radial Opposed Blade Damper Model 4275".

*Primary Examiner*—Harold Joyce

*Attorney, Agent, or Firm*—Michael, Best & Friedrich

[57] ABSTRACT

An opposed blade balanced damper includes three sector-shaped damper blades individually mounted to a frame for pivotal movement around a pair of pivot tabs integrally formed on each damper blade. A user-actuable control assembly simultaneously controls the relative rotational position of each damper blade so as to selectively regulate airflow through a duct. The damper blades and control assembly function to direct airflow toward the center of the duct and thereby maintain symmetrical airflow through the duct. This is achieved by rotating the damper blades so that the inner ends of the damper blades move downstream, and the outer ends of the damper blades move upstream, as the damper blades are rotated from a closed to an open position.

14 Claims, 2 Drawing Sheets

OPPOSED BLADE BALANCED DAMPER

BACKGROUND OF THE INVENTION

This invention relates generally to ventilating apparatus and in particular to dampers for regulating gas flow through a duct.

Adjustable dampers are commonly used in air distribution systems to balance airflow through ducts near the supply air discharge outlets. Occasionally, such dampers are also used to balance return air at or near the return air inlets.

Air ducts are manufactured in a variety of shapes, such as square, round and rectangular, and it is a common practice to provide a diffuser, or other form of air apparatus, at the supply air discharge outlets and the return air inlets. Dampers can be sized and shaped to fit the shape of either the duct or the inlet of a particular air apparatus. If necessary, adapters can be used to provide a transition between one duct shape and another.

When a damper is mounted on or near a diffuser, best overall performance is obtained when the damper provides an adjustable air restriction without adversely affecting the distribution pattern of the diffuser. Known round damper designs, such as opposed blade, butterfly, radial and shutter, succeed, with varying degrees of difficulty and effectiveness, in providing such desired performance. Those round damper designs which provide the desired performance with a minimum of complexity and cost are to be preferred.

In view of the foregoing, it is a general object of the present invention to provide a new and improved opposed blade balanced damper.

It is a more specific object of the present invention to provide an opposed blade balanced damper wherein the balanced damper provides an adjustable air restriction without adversely affecting the distribution pattern of a diffuser or other air apparatus.

It is a still more specific object of the present invention to provide an opposed blade balanced damper which can be easily and economically manufactured without sacrificing performance.

SUMMARY OF THE INVENTION

The invention is directed to an opposed blade balanced damper for controlling gas flow in a duct of substantially circular cross-section. The balanced damper includes a plurality of substantially identical, substantially planar, sector-shaped damper blades each including an apex end and an outer end opposite the apex end. Means are provided for supporting the damper blades within the duct for movement between a fully closed position, wherein the damper blades are substantially coplanar with one another and substantially oppose gas flow through the duct, and a fully open position wherein each damper blade is positioned so that the outer end is upstream and the apex end is downstream relative to gas flow through the duct so that gas flow through the duct is not substantially opposed. Control means are provided for moving the damper blades to, and retaining the damper blades in, selected positions between and including the fully closed and fully opened positions.

BRIEF DESCRIPTION OF THE DRAWINGS

The features of the invention which are believed to be novel are set forth with particularity in the appended claims. The invention, together with the further objects and advantages thereof, can best be understood by reference to the following description taken in conjunction with the accompanying drawings, in the several figures of which like reference numerals identify like elements, and in which:

DESCRIPTION OF THE PREFERRED EMBODIMENT

Figure 1:
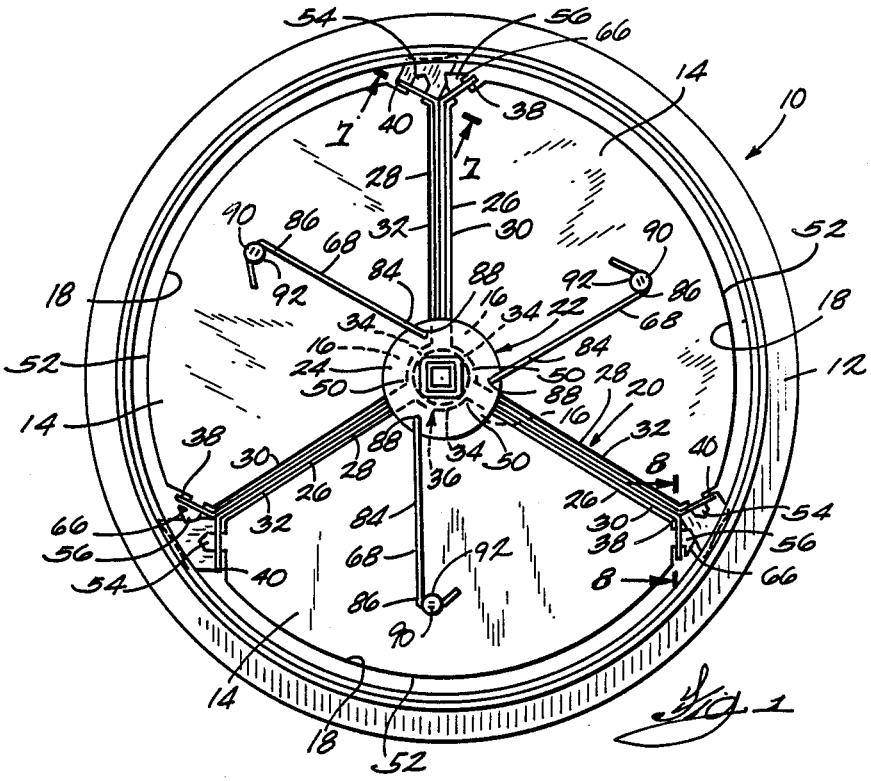
FIG. 1 is a top plan view of an opposed blade balanced damper embodying the invention and showing the damper blades in a closed position.
Figure 2:
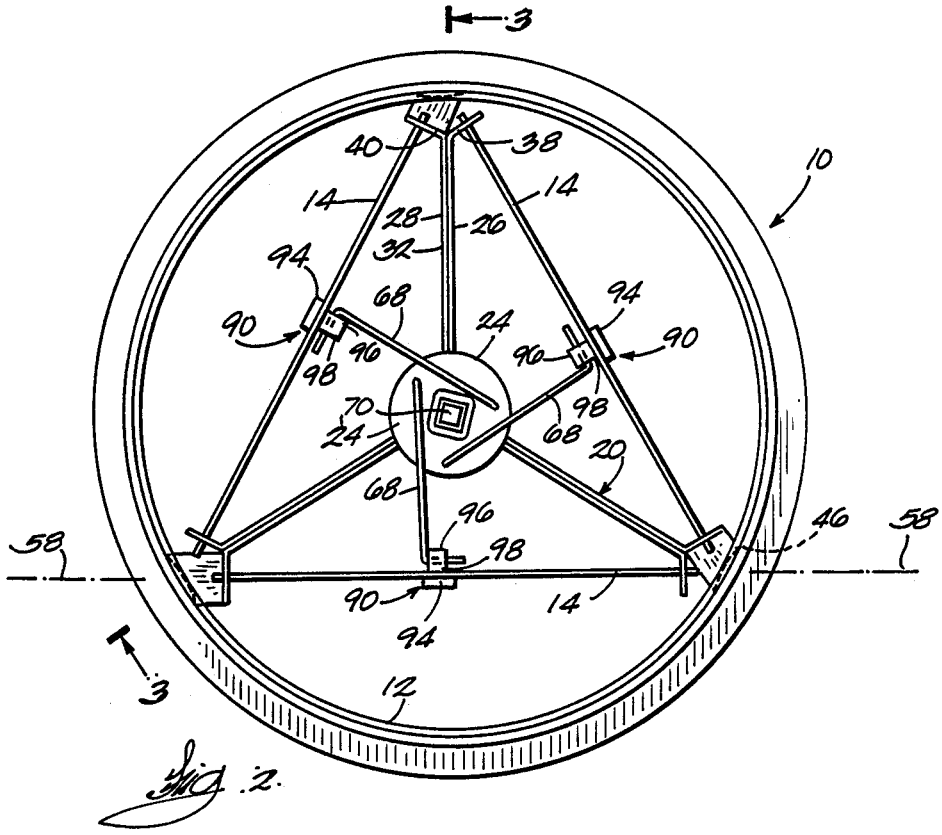
FIG. 2 is a top plan view of the opposed blade balanced damper illustrated in FIG. 1 showing the damper blades in an open position.
Figure 3:
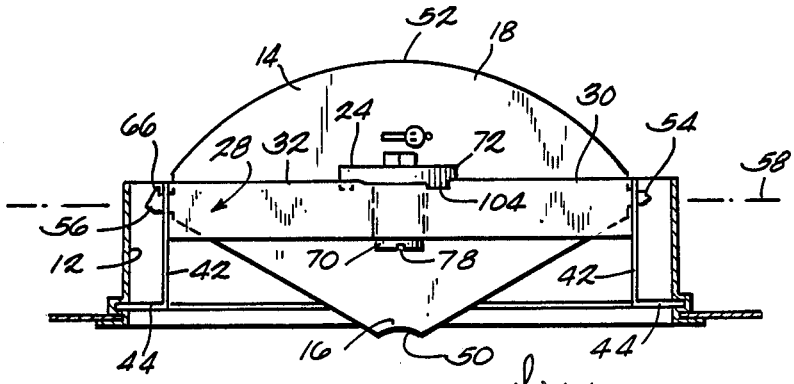
FIG. 3 is a cross-sectional view of the opposed blade balanced damper illustrated in FIG. 2 taken along line 3—3 thereof.
Figure 4:
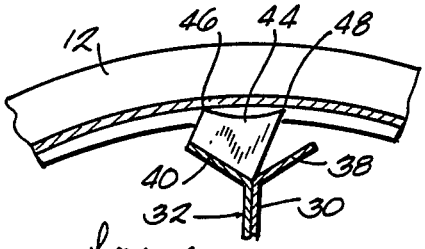
FIG. 4 is a fragmentary view of one end of a strut for supporting the opposed balanced damper within a duct.

An opposed blade balanced damper 10 embodying the invention as illustrated in the drawings. Referring specifically to FIGS. 1, 2 and 3, the opposed blade balanced damper 10 is adapted to fit within, and regulate gas flow through, a duct 12 of generally circular cross section. Preferably, both the opposed blade balanced damper 10, and the duct 12 itself are formed of a sheet metal such as sheet steel. It will be appreciated, however, that other materials can be utilized.

As illustrated, the opposed blade balanced damper 10 includes three substantially identical, substantially planar, sector-shaped damper blades 14, each including an inner or apex end 16 and an outer end 18 opposite the apex end 16. The opposed blade balanced damper 10 further includes a frame assembly 20 for supporting the damper blades 14 within the duct 12 for movement between a fully closed position, illustrated in FIG. 1, wherein the damper blades 14 are substantially co-planar with one another and substantially oppose gas flow through the duct 12, and a fully opened position, illustrated in FIG. 2, wherein each damper blade 14 is positioned so that the outer end 18 is upstream and the apex end 16 is downstream relative to the direction of gas flow through the duct 12 so that such gas flow is not substantially opposed when the opposed blade damper 10 is in the open position. In addition, the opposed blade damper further includes a control assembly 22, having a user-actuable control disc 24, for moving the damper blades 14 to, and retaining the damper blades in, selected positions between and including the fully closed and fully opened positions.

As illustrated, the frame assembly 20 includes three equally spaced, elongate struts 26 extending outwardly from a common center. In the embodiment illustrated, the angular spacing between adjacent struts 26 is substantially 120°. Preferably, the frame assembly 20 is formed of three substantially identical metal stampings 28 which are welded or otherwise fastened together, and each of the stampings 28 includes a pair of arms 30 and 32 oriented substantially 120° from each other. When fastened as illustrated in FIGS. 1 and 2, the opposed arms 30 and 32 of adjacent ones of the stampings 28 form the individual frame struts 26. Adjacent the center of the frame 20, each of the stampings includes an arcuate portion 34, and the arcuate portions of each of the three stampings combined to form a generally cylindrical hollow sleeve or tube 36 concentrically disposed around the frame center.

As best illustrated in FIGS. 1, 2, 3 and 4, the outermost ends of each of the stampings 28 forming the frame assembly 20 are bent toward each other so as to form a pair of substantially parallel flanges 38 and 40 at opposite ends of each sector defined by the struts 26 of the frame assembly 20. To support the frame 20 within the duct 12, one of the flanges 40 at the end of each strut 26 includes a downwardly depending leg 42 (FIG. 3) having a radially outwardly extending tab portion 44. The outermost edge of each tab portion 44 is inwardly curved so that a pair of spaced, outwardly directed points 46 and 48 (FIG. 4) are formed at the outermost point of each tab 44. These points 46 and 48 engage the interior of the duct 12 and function to support the frame 20, and the damper blades 14 supported thereon, within the duct 12. The struts 26 of the frame 20 are dimensioned so that each strut 26 is under slight compression when the opposed blade damper 10 is positioned within a duct 12. This permits the opposed blade damper 10 to be easily. quickly, and securely mounted within a duct 12 even though the duct might be somewhat out of round or somewhat larger or smaller than its nominal dimension.

As best illustrated in FIGS. 1 and 3, the apex end 16 of each damper blade 14 includes a concave inner edge 50 dimensioned to extend partially around the cylindrical hollow sleeve 36 at the center of the frame assembly 20. The edge 52 of each damper blade 14 opposite the apex end 16 is arc-shaped and corresponds in shape to an arc segment of a circle centered substantially at the center of the frame assembly 20.

To pivotally support each of the damper blades 14 within the interior of the duct 12, a pair of pivot tabs 54 and 56 are integrally formed on each of the damper blades. The pivot tabs 54 and 56 extend outwardly from the corners of the damper blades 14 to form a pivot axis 58 along a chord of the circle defined by the arc-shaped outer edge 52 of the damper blade 14.

Figure 7:
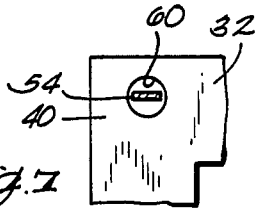
FIG. 7 is a cross-sectional view of the opposed blade balanced damper shown in FIG. 1 taken along lines 7—7 thereof.
Figure 6:
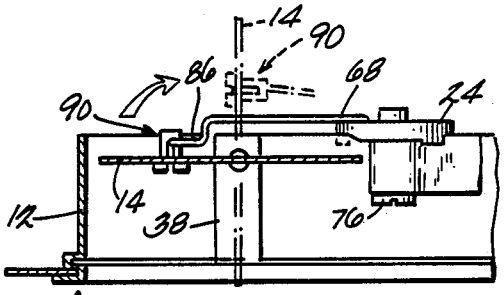
FIG. 6 is a fragmentary side elevational view of the opposed blade balanced damper showing movement of one damper blade from the closed position to the open position.
Figure 8:
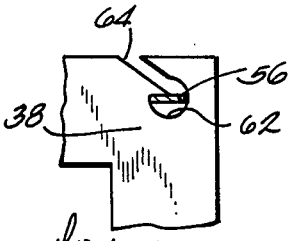
FIG. 8 is a cross-sectional view of the opposed blade balanced damper illustrated in FIG. 1 taken along line 8—8 thereof.

As illustrated in FIGS. 7 and 8, the opposed, substantially parallel, flanges 38 and 40 within each of the sectors defined by the struts 26 of the frame assembly 20 are provided with apertures 60 and 62 dimensioned to receive the pivot tabs 54 and 56 of the damper blades 14. To permit installation and removal of the damper blades 14 relative to the frame assembly 20, one of the flanges 38 is provided with an angled slot 64 extending from the upper edge of the flange downwardly toward the aperture 62. By first placing one of the pivot tabs 54 into the aperture 60 of the opposing flange 40, the remaining pivot tab 56 can be inserted downwardly through the slot 64 into the aperture 62 of the remaining flange 38 after which the damper blade 14 can pivot around the pivot axis 58 defined by the pivot tabs 54 and 56. To help retain the damper blades 14 in position relative to the frame assembly 20, one of the pivot tabs 56 of each damper blade 14 is preferably provided with a spur 66 (FIG. 3) extending beyond the periphery of the aperture 62 formed in the adjacent frame flange 38.

The position of each of the damper blades 14 is simultaneously controlled by means of the user-actuable control assembly 22 which includes the control disk 24 rotatably mounted at the center of the frame 20 and a plurality of elongate control linkage members or rods 68 individually coupled between the control disk 24 and each of the damper blades 14.

Figure 5:
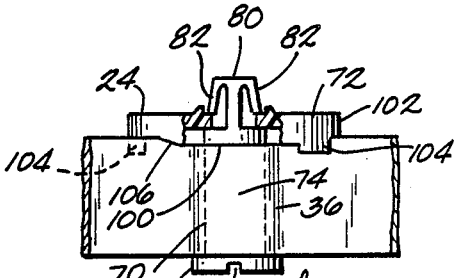
FIG. 5 is a side elevational view, partially in section, of a control disc assembly for controlling operation of the opposed blade balanced damper.

As illustrated in FIG. 5, the control disk 24 is formed in two parts and includes a lower element or pivot member 70 and an upper element or disk member 72 each preferably formed of a durable, semi-rigid plastic or similar material. The lower element 70 includes an elongate cylindrical shank portion 74, dimensioned to extend through the hollow sleeve 36 of the frame assembly 20, and an enlarged head portion 76 which limits the upward travel of the pivot member 70 through the hollow sleeve 36. A slot 78 across the head 76 permits the control assembly 22 to be rotated with a screwdriver or similar adjusting tool. The disk member 72 is generally circular in form and includes a central aperture. The uppermost end 80 of the pivot member 70 is generally tapered in form and includes a pair of opposed splayed tabs 82. By pressing the disk member 72 downwardly onto the pivot member 70 so that the tapered end 80 enters the aperture of the disk member 72, the opposed tabs 82 are initially displaced toward each other until they clear the upper surface of the disk member 72 after which the tabs 82 spring outwardly to lock the pivot member 70 to the disk member 72 and thereby secure the control disk 24 to the frame 20.

The control linkages 68 are each connected at their inner ends 84 to the control disk 24 and at their outer ends 86 to the damper blades 14. To connect the inner ends 84 of the control linkages to the control disk 24, three holes 88 are formed adjacent the periphery of the disk member 72, and the inner end 84 of each control linkage 68 extends through an individual one of the holes 88. Preferably, a downwardly directed bend is formed adjacent the inner end 84 of each control linkage 68 to facilitate coupling the control linkage to the control disk 24.

Figure 9:
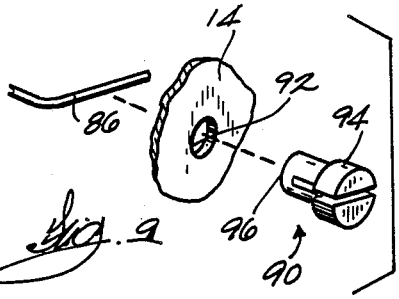
FIG. 9 is an exploded perspective view showing, in detail, a pivot button for securing a control linkage to a damper blade.

The outer ends 86 of the control linkages 68 are coupled to the individual damper blades 14 by means of a Plurality of pivot buttons 90, preferably formed of the same material as the control disk 24, extending into circular apertures or holes 92 formed through the plane of each damper blade 16. As best illustrated in FIG. 9, each pivot button 90 includes a head portion 94 of greater dimension than the dimension of the aperture 92 in the adjacent damper blade 14 and further includes a relatively narrow stem portion 96 extending from the head portion 94 so as to extend through and project beyond the adjacent damper blade 14 when the stem portion 96 is inserted through the aperture 92. Movement of the pivot button 90 through the aperture 92 is limited by reason of the enlarged head 94 coming into contact with the damper blade 14.

To pivotally secure the outer end 86 of each control linkage 68 to a damper blade 14, a slot 98 extends through the portion of the pivot button stem 96 projecting beyond the damper blade 14 and is dimensioned to receive the outer end 86 of the control linkage 68 extending toward the damper blade 14. After the pivot button 90 is inserted through the damper blade 14, the outer end 86 of the control linkage 68 can be inserted through the slot 98 to couple the control linkage 86 to the damper blade 14 and prevent withdrawal of the pivot button 90 from the aperture 92. As illustrated, the outer end 86 of each control linkage 68 is bent at a right angle adjacent the pivot button 90 so that the control linkage 68 can pivot relative to the damper blade 14 as the damper blade pivots around the pivot axis 58.

The pivot buttons 90 and the holes 88 in the control disk 24 are located so that each of the control linkages 68 extends generally perpendicularly relative to the pivot axis 58 defined by the pivot tabs 54 and 56 of each damper blade 14 and so that each control linkage 68 extends along a chord, rather than a radius, of the disk member 72. When so positioned and mounted, rotation of the control disk 24 results in inward or outward movement of the control linkages 68 relative to the frame assembly 20 resulting in rotational movement of each damper blade 14 around its pivot axis 58. Thus, rotation of the control disk 24 results in simultaneous movement of the individual damper blades 14 from the fully closed position, shown in FIG. 1, to the fully opened position, shown in FIG. 2. Preferably, the control linkages 68 are dimensioned and shaped so that each control linkage 68 is under slight compression when the damper blades 14 are in the fully closed position. This helps keep the closed damper blades 14 from fluttering and helps assure quiet damper operation.

In accordance with one aspect of the invention, the control disk 24, the control linkages 68 and the pivot buttons 90 are arranged so that the outer end 18 of each blade 14 moves upstream relative to the direction of gas flow through the duct 12, while the apex end 16 moves downstream as the control disk 24 rotates to move the damper blades 14 from the closed position to the open position. By moving the damper blades 14 in this manner, air flow is at all times directed toward the center of the duct 12 when the damper blades 14 are between the fully opened and fully closed positions. This maintains substantially symetrical gas flow through the duct 12 which, in turn, promotes uniform distribution of the air by an air diffuser located downstream of the damper 10. Thus, the illustrated damper 10 promotes uniform distribution of the air regardless of the setting or position of the damper blades 14.

To retain the damper blades 14 at selected positions between the fully open and fully closed positions, the underside of the control disk 24 includes a cam surface 100 which is shaped so as to engage the upper edges of the struts 26 of the frame assembly 20 when the control disk 24 is within one range of rotational positions relative to the frame 20 and disengage the frame when the control disk is within another range of rotational positions relative to the frame. To this end, the underside of the control disk 24 is provided with a downwardly depending, cylindrically shaped sleeve or rim 102 (FIG. 5 located beneath the outer peripheral edge of the control disk 24. The lowermost edge of the rim 102 is shaped so that three downwardly depending, equally spaced stop tabs 104 are formed on the under-surface of the control disk 24. The stop tabs 104 are positioned between adjacent pairs of the frame assembly struts 26 and function to limit the rotational range of the control disk 24 by coming into contact with the struts 26 at the limits of rotational movement (corresponding to fully open and fully closed damper blades) in either direction. Between the stop tabs 104, the thickness or height of the rim 102 varies between a minimum which avoids contact with the upper edges of the struts 26, and a maximum which permits such contact. When the control disk 24 is rotated from the position shown in FIG. 5, the thickness of the rim 102 is such that the control disk 24 is biased upwardly against the retaining force of the control disk pivot member 70 and such that substantial friction is developed between the control disk 24 and the struts 26 of the frame assembly 20. A transition zone 106 between the relatively thin and relatively thick areas of the control disk underside defines the boundary between the aforementioned ranges of rotational position wherein the control disk 24 does or does not contact the frame assembly 20 with substantial force. Preferably, the transition zoning is located so that substantial friction against the frame assembly 20 is developed only when the damper blades 14 are other than in the fully closed position.

An additional advantage of the cam surface arrangement is that, when the damper blades 14 are closed, no substantial force is developed on the control disk elements 70 and 72. Accordingly, the damper unit 10 can then be cleaned with heated chemicals or baked without risking deformation of the control disk 24 and destruction of the ability of the control disk 24 to develop friction when desired.

The opposed blade balanced damper 10 provides many advantages over previously known damper designs. The movement of the damper blades 14 is such that air is funneled to the center of a diffuser for uniform distribution with low resistance to flow when the damper is fully opened. Furthermore, the pivot tabs 54 and 56 around which the damper blades 14 rotate are integrally formed which simplifies assembly and reduces manufacturing costs. Finally, the control disk elements 70 and 72, and the pivot buttons 90, facilitate simple and rapid assembly of the damper which further contributes to manufacturing economy.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. An opposed blade balanced damper for controlling gas flow in a duct of substantially circular cross section, said balanced damper comprising:

a plurality of substantially identical, substantially plan sector-shaped damper blades each including an apex end and an outer end opposite said apex end;

means for supporting said damper blades within the duct movement between a fully closed position, wherein said damper blades are substantially coplanar with one another and substantially oppose gas flow through the duct, and a fully open position, wherein each damper blade is positioned so that said outer end is upstream and said apex end is downstream relative to gas flow through the duct so that gas flow through the duct is not substantially opposed; and user actuable control means centrally disposed relative to said damper blades and accessible from a downstream position relative to the direction of gas flow through the duct for moving said damper blades to, and retaining said damper blades in, selected positions between and including said fully closed and fully opened positions.

2. An opposed blade balanced damper in accordance with claim 1 wherein said apex ends of said damper blades are adjacent each other when said damper blades are in said fully closed position, and wherein said damper blades move substantially in unison so that gas flow is directed substantially toward the center of the duct when the damper blades are between said fully opened and fully closed positions.

3. An opposed blade balanced damper in accordance with claim 2 wherein said supporting means comprises a plurality of elongated struts extending radially outwardly from a common center and wherein each of said damper blades is disposed substantially within a sector defined between adjacent ones of said struts.

4. An opposed blade balanced damper for controlling gas flow through a duct, said damper comprising:

a plurality of substantially sector-shaped damper blades;

a frame comprising a plurality of elongate struts extending radially outwardly from a common center for supporting said damper blades for movement between a fully closed and a fully opened position relative to the duct;

of elongate linkage members individually coupled to individual ones of said damper blades and extending toward said common center;

a control disk positioned over said frame and mounted–for rotation around an axis extending through said common center, said control disk being coupled to said plurality of linkage members so that rotation of said control disk relative to said frame moves said damper blades relative to said frame, said control disk having an underside including a cam surface shaped so that said cam surface engages said frame when said control disk is within one range of rotational positions relative to said frame and disengages said frame when said control disk is within another range of rotational positions relative to said frame so that said cam surface opposes rotational movement of said control disk relative to said frame when said control disk is in said one range of rotational positions relative to said frame.

5. An opposed blade balanced damper in accordance with claim 4 wherein said control disk includes a downwardly extending tubular rim having a lowermost edge and wherein said cam surface is formed on said lowermost edge of said tubular rim.

6. An opposed blade balanced damper in accordance with claim 5 wherein said balanced damper further comprises a stop member for limiting upward movement of said control disk away from said frame and wherein said cam surface is shaped to bias said control disk upwardly against said stop member when said control disk is in said one range of rotational positions relative to said frame.

7. An opposed blade balanced damper in accordance with claim 6 further comprising limit means for limiting the range of rotational movement of said control disk relative to the frame.

8. An opposed blade balanced damper in accordance with claim 7 wherein said limit means includes a tab projecting downwardly from said lowermost edge of said tubular rim and positioned so as to engage adjacent ones of said struts to limit the range of rotational movement of said control disk relative to said frame.

9. An opposed blade balanced damper for controlling gas flow in a duct of substantially circular cross-section, said balanced damper comprising:

three substantially identical, substantially planar damper blades, each having substantially the shape of a sector subtending substantially 120° of arc and including an apex end and an outer end opposite said apex end;

mounting means for supporting said damper blades within the duct for movement between a fully closed position, wherein said damper blades are substantially coplanar with one another and substantially oppose gas flow through the duct, and a fully opened position wherein said damper blades are displaced from said coplanar alignment with one another so as to reduce opposition to gas flow through the duct; and user-actuable control means centrally disposed relative to said damper blades and accessible from a downstream position relative to the direction of gas flow through the duct for moving said damper blades from said closed position towards said open position and for retaining said damper blades in user-selected positions between and including said closed and opened positions to provide regulated gas flow through the duct, said user-actuable control means being operable to displace said damper blades so that said apex ends move in a downstream direction relative to gas flow through the duct and said opposite ends move in an upstream direction relative to said gas flow through the duct when said damper blades are moved from said closed position toward said open position.

10. An opposed blade balanced damper in accordance with claim 9 wherein said user-actuable control means is adapted to be engaged by a user-manipulated tool to permit user-adjustment of the position of said damper blades between said opened and said closed positions.

11. An opposed blade balanced damper for controlling gas flow through a duct, said balanced damper comprising:

a plurality of substantially sector-shaped damper blades each having an upper planar surface and an aperture opening through said planar surface;

a frame for pivotally supporting said damper blades for movement between a closed position and an opened position relative to the duct;

a control disk rotatably mounted to said frame;

a plurality of elongate control linkages each having one end coupled to said control disk and a remaining end extending toward and terminating adjacent one of said damper blades; and a plurality of pivot buttons for pivotably coupling said remaining ends of said control linkages with said adjacent ones of said damper blades, each of said pivot buttons comprising:

a head portion of greater dimension than the dimension of said aperture in said adjacent damper blade;

a relatively narrow stem portion extending from said head portion and dimensioned to extend through and project beyond said adjacent damper blade when said stem portion is inserted through said adjacent damper blade when said stem portion is inserted through said aperture and said head position engages said adjacent damper blades;

said pivot button further including a slot extending through said portion of said stem projecting beyond said damper blade for receiving said remaining end of said control linkage and pivotally coupling said control linkage with said adjacent damper blade.

12. An opposed blade balanced damper for controlling gas flow in a duct of substantially circular cross-section, said balanced damper comprising:

a plurality of substantially identical, substantially planar, sector-shaped damper blades each including an apex end and an outer end opposite said apex end;

means for supporting said damper blades within the duct for movement between a fully closed position, wherein said damper blades are substantially coplanar with one another and substantially oppose gas flow through the duct, and a fully open position, wherein each damper blade is positioned so that said outer end is upstream and said apex end is downstream relative to gas flow through the duct so that gas flow through the duct is not substantially opposed;

said damper blades each including first and second opposite side edges extending from said apex end to said outer end;

said means for supporting said damper blades includes frame means and pivot means at each of said opposite side edges pivotally engaging said frame means so that said damper blades are pivotally supported from said frame means; and control means for moving said damper blades to, and retaining said damper blades in, selected positions between and including said fully closed and fully opened positions.

13. An opposed blade balanced damper in accordance with claim 12 wherein said pivot means comprise tabs integral with and projecting from said damper blade side edges.

14. An opposed blade balanced damper in accordance with claim 13 wherein:

said outer ends of said damper blades are arc-shaped defining an arc segment of a circle centered substantially at said apex; and said tabs are located generally adjacent the juncture of said side edges with said arc segment, said tabs extending oppositely generally along a chord of the circle defined by said arc-shaped outer edge so that said damper blades are pivotally supported from said frame for rotation about an axis extending substantially along said chord.

* * * * *

UNITED STATES PATENT AND TRADEMARK OFFICE

CERTIFICATE OF CORRECTION

PATENT NO. : 4,817,508

DATED : April 4, 1989

INVENTOR(S) : Kenneth Prochnow

It is certified that error appears in the above-identified patent and that said Letters Patent is hereby corrected as shown below:

Column 6, in Claim 1, line 52, "plan" should be --planar,--; and in Claim 1, line 56, between "duct" and "movement" --for-- should be inserted.

Column 7, in Claim 4, line 27, before "of" --a plurality-- should be inserted.

Signed and Sealed this

Fourteenth Day of May, 1991

*Attest:*

*Attesting Officer*

HARRY F. MANBECK, JR.

*Commissioner of Patents and Trademarks*